US008183479B2

(12) United States Patent
Mittu et al.

(10) Patent No.: US 8,183,479 B2
(45) Date of Patent: May 22, 2012

(54) LOCK MOUNTING DEVICE

(75) Inventors: Mahadeva Mittu, Karnataka (IN); Samir Rajauria, Agra Uttar Pradesh (IN); Lars Pommerencke, Neumunster (DE)

(73) Assignee: General Electric Company, Schenectady, NY (US)

( * ) Notice: Subject to any disclaimer, the term of this patent is extended or adjusted under 35 U.S.C. 154(b) by 531 days.

(21) Appl. No.: 12/434,252

(22) Filed: May 1, 2009

(65) Prior Publication Data

US 2010/0276261 A1 Nov. 4, 2010

(51) Int. Cl.
*H01H 9/28* (2006.01)

(52) U.S. Cl. ..... 200/43.14; 200/43.11

(58) Field of Classification Search ..... 200/43.14
See application file for complete search history.

(56) References Cited

U.S. PATENT DOCUMENTS

| | | | | |
|---|---|---|---|---|
| 1,774,628 | A * | 9/1930 | Andersen | 200/293 |
| 4,554,421 | A | 11/1985 | Grunert | |
| 5,146,056 | A * | 9/1992 | Kuczynski | 200/296 |
| 5,166,651 | A * | 11/1992 | Jacobs et al. | 335/202 |
| 5,693,923 | A | 12/1997 | Gula et al. | |
| 5,769,208 | A | 6/1998 | Griffith | |
| 5,905,239 | A | 5/1999 | Turner et al. | |
| 6,446,475 | B1 * | 9/2002 | Agnatovech et al. | 70/379 R |
| 2008/0277249 | A1 * | 11/2008 | Zubieta et al. | 200/43.11 |

FOREIGN PATENT DOCUMENTS

WO WO2008/0552548 A1 5/2008

OTHER PUBLICATIONS

Electrical Accessories, Motor Operators, Stored Energy Motor Operators, S3-S7. http://www.abb-control.com/pdf/catalog/ac1000/15.57.pdf.

http://library.abb.com/global/scot/scot208.nsf/veritydisplay/600ba6bef323c5b1a1256ea10038c86b/$File/ITSCE-601778552.pdf.

* cited by examiner

*Primary Examiner* — Elvin G Enad
*Assistant Examiner* — Lisa Homza
(74) *Attorney, Agent, or Firm* — Global Patent Operation; Stephen G. Midgley

(57) ABSTRACT

A lock housing for a circuit breaker accessory housing includes a body having a aperture configured to receive a keyed lock, a collar circumscribing the aperture at a first end of the housing, the collar extending radially outward from the body, and at least one resilient member integral to the housing, the at least one resilient member configured to engage the circuit breaker accessory housing.

7 Claims, 6 Drawing Sheets

LOCK MOUNTING DEVICE

BACKGROUND

1. Field

The subject matter described herein relates generally to circuit breaker accessories and, more particularly, to lock assemblies for circuit breaker accessories.

2. Related Art

It is known in the art to provide molded case circuit breakers for electrical systems. The circuit breaker is operative to disengage the electrical system under certain operating conditions. The use of accessories such as, for exemplary purposes only, motor operators to allow the motor-assisted operation of electrical circuit breakers is well known. The motor operator allows the circuit breaker to be operated remotely and to be opened, closed or reset after tripping of the circuit breaker.

The motor operator is typically secured to the top of a circuit breaker housing. A lever within the motor operator mechanically interacts with a circuit breaker operating handle, which extends from the circuit breaker housing. The lever is operatively connected to a motor within the motor operator. The motor drives the lever, which, in turn, moves the operating handle to operate the circuit breaker. The operating handle is moved between "on", "off", and "reset" positions, depending on the rotational direction of the motor.

A plurality of buttons external to the motor operator controls electrical current to the motor. The rotational direction of the motor is changed depending on which of these buttons is selected by operating personnel. Thus, the operating personnel can select one button to place the operating handle in the "on" position, and another button to place the operating handle in the "off" or "reset" positions.

When the handle is moved to the "on" position, electrical contacts within the circuit breaker are brought into contact with each other, allowing electrical current to flow through the circuit breaker. When the handle is moved to the "off" position, the electrical contacts are separated, stopping the flow of electrical current through the circuit breaker. When the handle is moved to the "reset" position, an operating mechanism within the circuit breaker is reset, as is necessary after the operating mechanism has tripped in response to an overcurrent condition in the electrical circuit being protected by the circuit breaker.

In one example, the circuit breaker accessory such as the motor operator described above may include one or more lockout devices such as padlocks or keyed cylinders for preventing unauthorized operation of the motor operator. In one example, the lockout devices may disable the motor operator mechanism in any suitable manner. Generally the padlocks are inserted through an aperture in a piece of, for example, the motor operator mechanism that protrudes through the motor operator housing or cover. The keyed cylinders are generally installed by opening the housing of, for example, the motor operator and assembling the keyed cylinder onto the housing.

It would be advantageous to be able to install a keyed cylinder onto a circuit breaker accessory in the field without removing or opening the housing of the circuit breaker accessory.

BRIEF DESCRIPTION OF THE EMBODIMENTS

In accordance with one exemplary embodiment, a lock housing for a circuit breaker accessory housing includes a body having a aperture configured to receive a keyed lock, a collar circumscribing the aperture at a first end of the housing, the collar extending radially outward from the body, and at least one resilient member integral to the housing, the at least one resilient member configured to engage the circuit breaker accessory housing.

In accordance with another exemplary embodiment, a lock assembly for a circuit breaker accessory housing is disclosed, the housing comprising a retaining feature, wherein the lock assembly includes a keyed lock and a lock housing having an aperture configured to retain the keyed lock, a collar circumscribing the aperture; and at least one resilient member adjacent the aperture, wherein the collar and the at least one resilient member cooperate to capture the retaining feature.

In accordance with another exemplary embodiment, a circuit breaker accessory includes a circuit breaker accessory housing having an aperture and a lip surrounding the aperture, and a lock assembly secured to the circuit breaker accessory housing, the lock assembly configured to selectively disable the circuit breaker accessory, wherein the lock assembly includes a keyed lock, and a lock housing having an aperture configured to retain the keyed lock, a collar circumscribing the aperture, and at least one resilient member adjacent the aperture, wherein the collar and the at least one resilient member cooperate to capture the lip of the circuit breaker accessory housing.

In accordance with still another exemplary embodiment, a method of installing a lock assembly on a circuit breaker accessory housing includes inserting the lock assembly through an aperture in a surface of the circuit breaker accessory housing without opening the circuit breaker accessory housing, and capturing a lip of the aperture within a channel of the lock assembly such that the lip is substantially contacted on a first side by a resilient member of the lock assembly and on a second opposite side by a collar of the lock assembly.

BRIEF DESCRIPTION OF THE DRAWINGS

The following detailed description is made with reference to the accompanying drawings, in which.

DETAILED DESCRIPTION OF THE PREFERRED EMBODIMENTS

Figure 1:
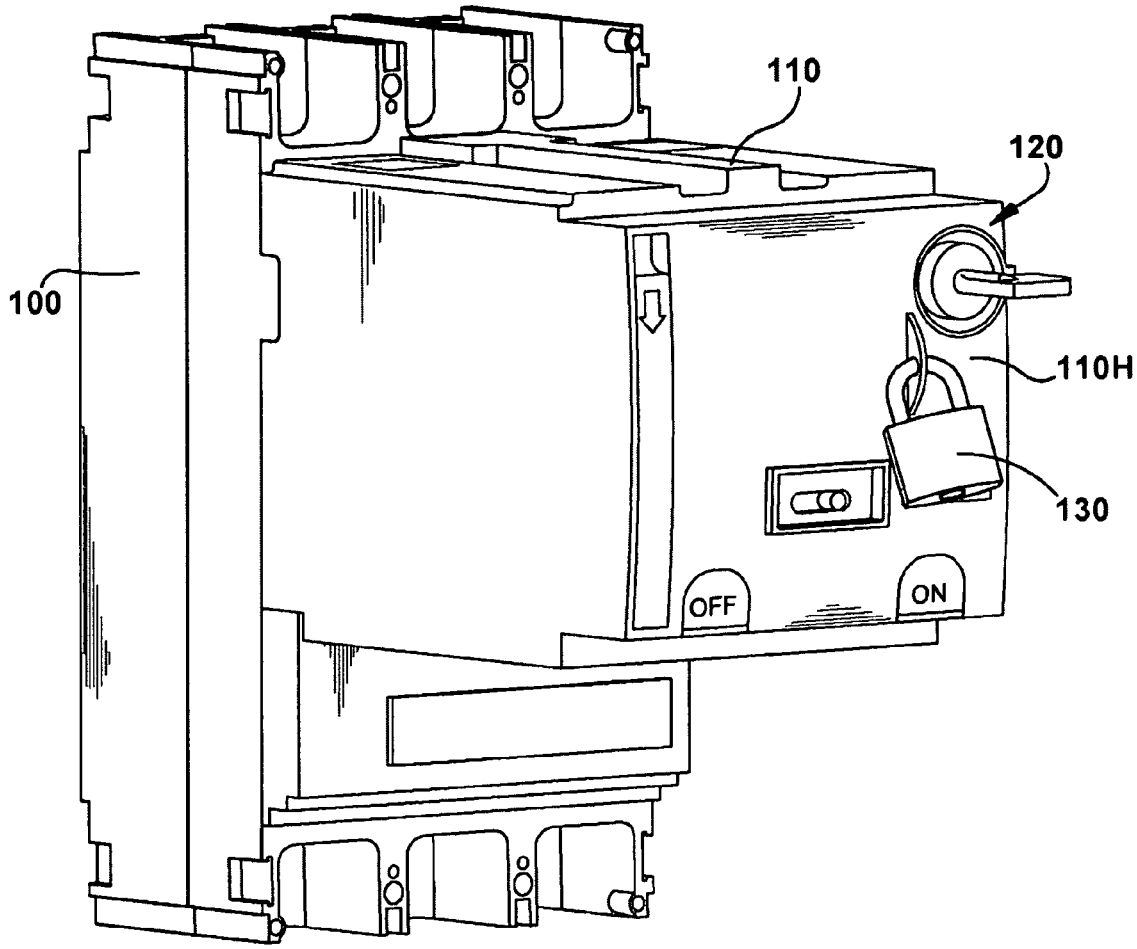
FIG. 1 is a schematic illustration of a circuit breaker accessory coupled to a circuit breaker in accordance with an exemplary embodiment.
Figure 2:
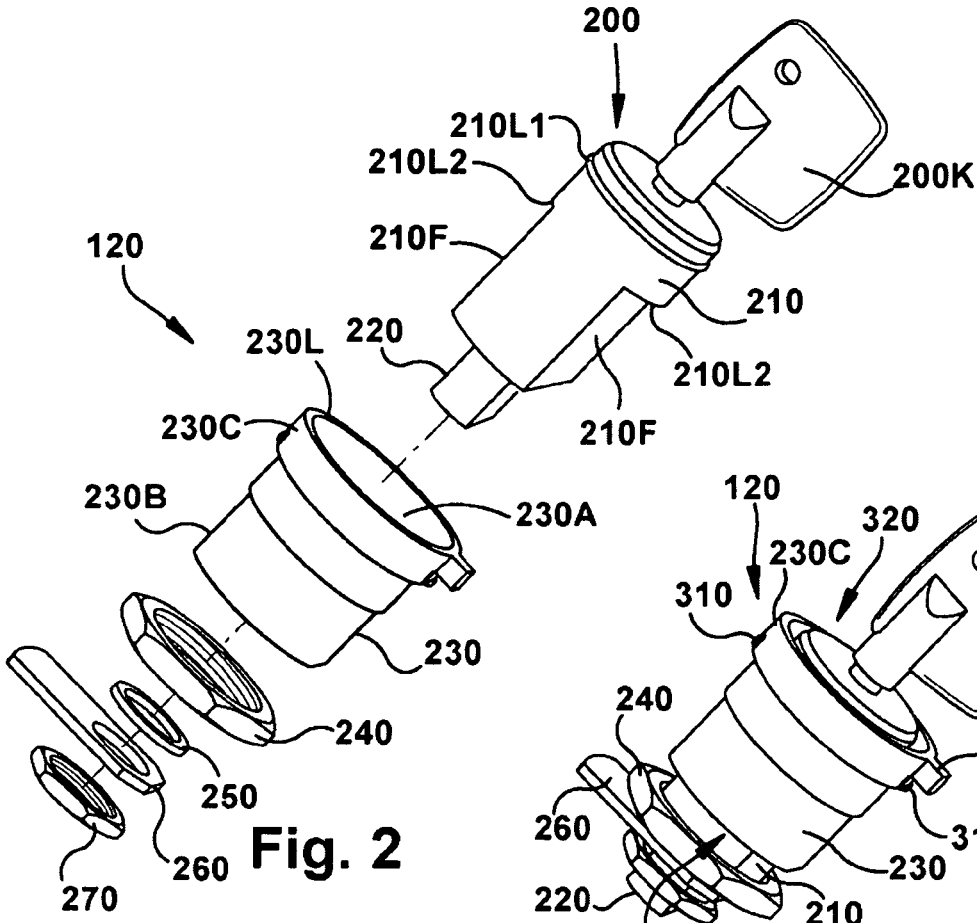
FIG. 2 is an exploded illustration of a lock assembly in accordance with an exemplary embodiment.
Figure 3:
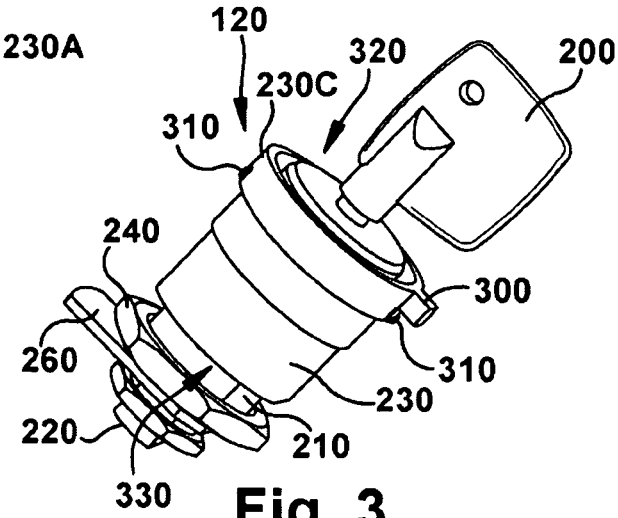
FIG. 3 is a schematic illustration of the lock assembly of FIG. 2 in accordance with an exemplary embodiment.
Figure 4:
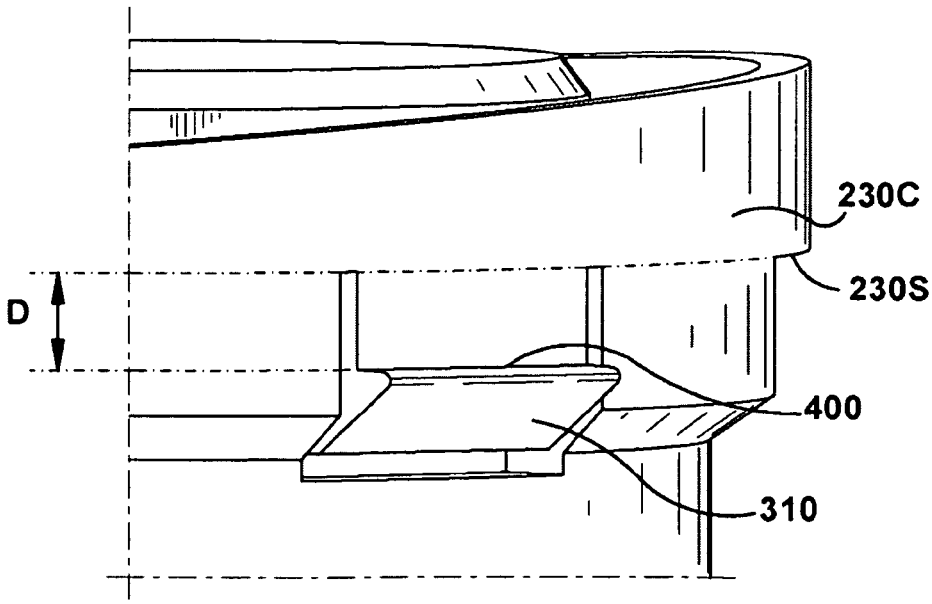
FIG. 4 is a schematic illustration of a portion of the lock assembly of FIG. 2 in accordance with an exemplary embodiment.

In one exemplary embodiment, referring to FIG. 1 a motor operator 110 is shown installed on a circuit breaker 100.

Although the embodiments disclosed will be described with reference to the drawings, it should be understood that the embodiments disclosed can be embodied in many alternate forms. In addition, any suitable size, shape or type of elements or materials could be used. It should also be understood that while the exemplary embodiments are described herein with respect to motor operator 110, that the exemplary embodiments can be equally applied to any suitable circuit breaker accessory.

The exemplary embodiments provide a user friendly lock assembly 120 for a circuit breaker accessory such as, for example, motor operator 110 that can be easily installed in the field. In accordance with an exemplary embodiment the lock assembly can be installed on the housing 110H of the motor operator 110 without removing or opening the housing 110H of the motor operator 110. The lock assembly 120 may be configured to engage any suitable portion of the motor operator mechanism for selectively disabling the motor operator and preventing unauthorized operation of the motor operator. The lock assembly 120 may be used in lieu of or in conjunction with other lockout devices such as a padlock 130.

Referring to FIGS. 2-6 the lock assembly includes a keyed lock 200 and a lock mounting device in the form of a lock housing 230. The lock mounting device, or housing 230 is a cylindrical housing having a body 230B with a center aperture 230A. The lock housing 230 may be formed in any suitable manner of any suitable material including but not limited to, plastics, metals and composites. A first end 320 of the housing includes a collar 230C that extends radially outward away from the body 230B so as to form a shoulder 230S between the collar 230C and body 230B. The lock housing 230 includes at least one tab 300 extending radially outward from the collar 230C. The tab 300 may have any suitable configuration for interfacing with the motor operator housing 110H for substantially preventing rotation of the lock housing 230 when the lock assembly 120 is installed on the motor operator housing 110H as will be described below. In other examples, relative movement between the lock mounting device, also referred to as the lock housing 230, and the motor operator housing 110H may be achieved in any suitable manner. The lock housing 230 may also include at least one resilient member 310 integrally formed in the body 230B adjacent the collar 230C. In other examples the resilient member 310 may be affixed to the lock housing 230 in any suitable manner. In this example, the lock housing 230 includes two resilient members 310 disposed substantially opposite one another on the lock housing 230. In other examples there may be more than two resilient members 310 having any suitable positional relationship with each other. Each of the resilient members 310 includes a lip 400 that extends radially outward from the body 230B. The lip 400 is spaced apart from the shoulder 230S by a suitable distance D so that the lip 400 and the shoulder 230S form respective channels 630. Each channel 630 is configured so that a portion of the motor operator housing 110H is accepted in the channel 630 for retaining the lock assembly 120 on the motor operator housing 110H as will be described below. In other examples the lock housing 230 may have any suitable configuration.

Figure 5:
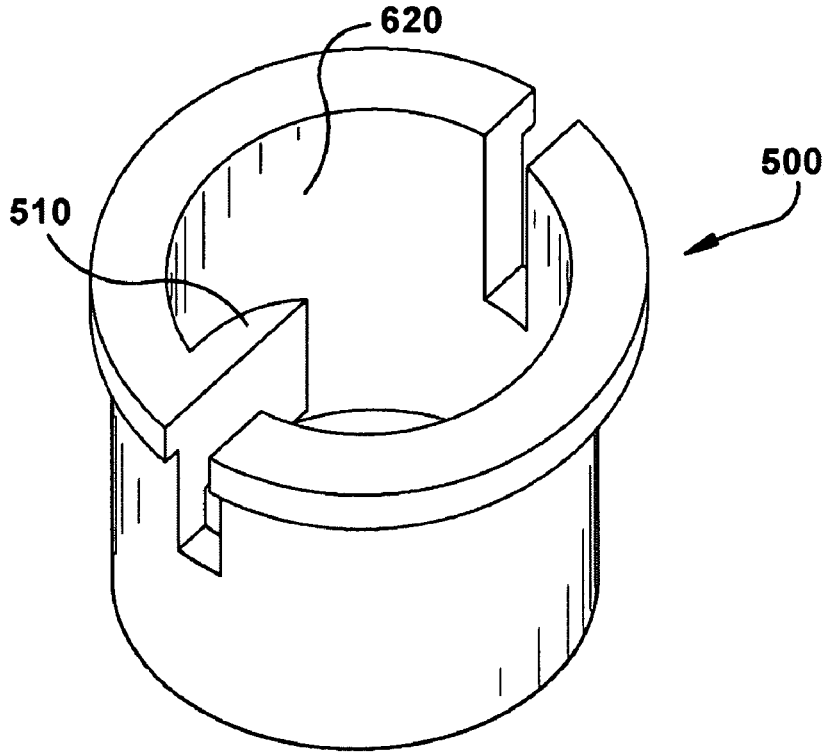
FIG. 5 is a schematic illustration of a portion of the lock assembly of FIG. 2 in accordance with an exemplary embodiment.
Figure 6:
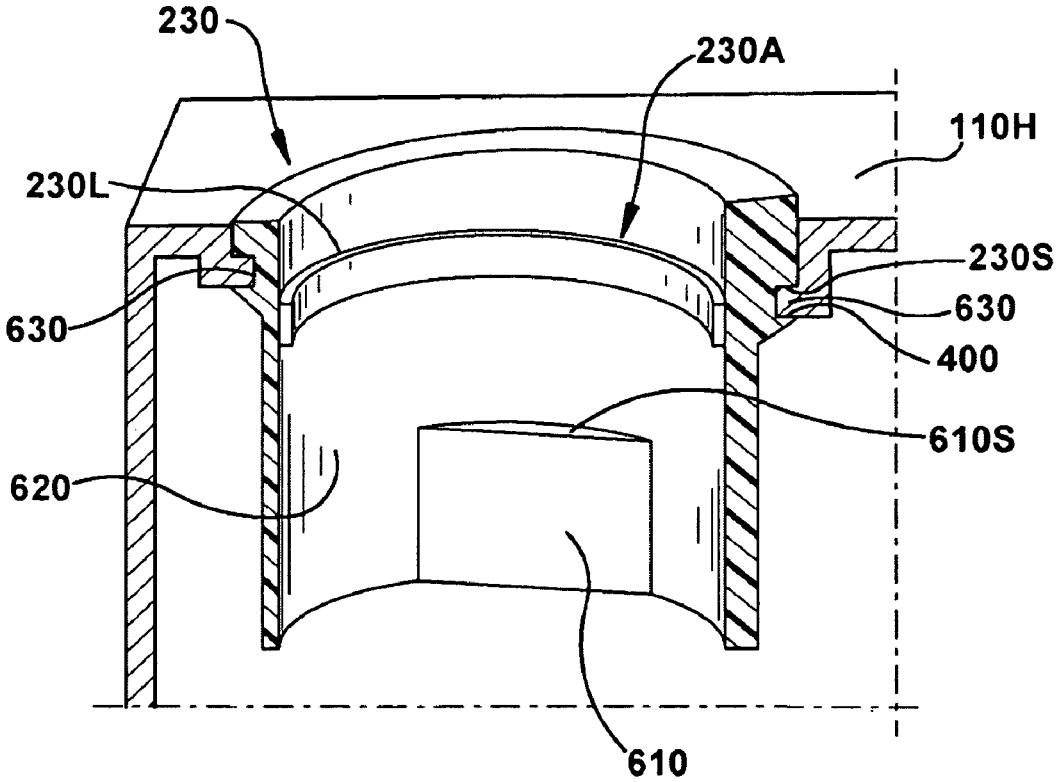
FIG. 6 is a schematic illustration of a portion of the lock assembly of FIG. 2 in accordance with an exemplary embodiment.

The keyed lock 200 may be any suitable lock including but not limited to Ronis and Proflux key locks. In one example, the keyed lock 200 includes a lock body 210, key 200K and a cam 260. The lock body 210 may include at least one orientation surface such as, for exemplary purposes only, flat surfaces 210F formed in the lock body 210 for substantially preventing rotation of the lock body 210 within the lock housing 230. In this example, the flat surfaces 210F of the lock body 210 substantially contact corresponding orientation surfaces, such as flat surfaces 610, formed on an inner wall 620 of the aperture 230A of the lock housing 230. In other examples the lock body 210 may include at least one slot (not shown) formed in the lock body 210 that is configured to substantially engage a corresponding tab of the lock housing 500 (which may be substantially similar to lock housing 230), such as tab 510, that extends radially inward from the inner wall 620 of the aperture 230A for substantially preventing rotation of the lock body 210 within the lock housing 230 (FIG. 5). In still other examples, relative movement between the lock body 210 and the lock housing 230 may be prevented in any suitable manner. In one example, the lock body 210 may include a lock body lip 210L1 that is configured to substantially engage a retaining feature in the form of a lip 230L disposed on the inner wall 620 of the aperture for preventing the lock body 210 from passing through the aperture. In another example, the flat surfaces 210F may form shoulders 210L2 that are configured to substantially abut shoulders 610S formed by the flat surfaces 610 on the inner wall 620 of the aperture 230A for preventing the lock body 210 from passing through the aperture 230A.

Figure 7:
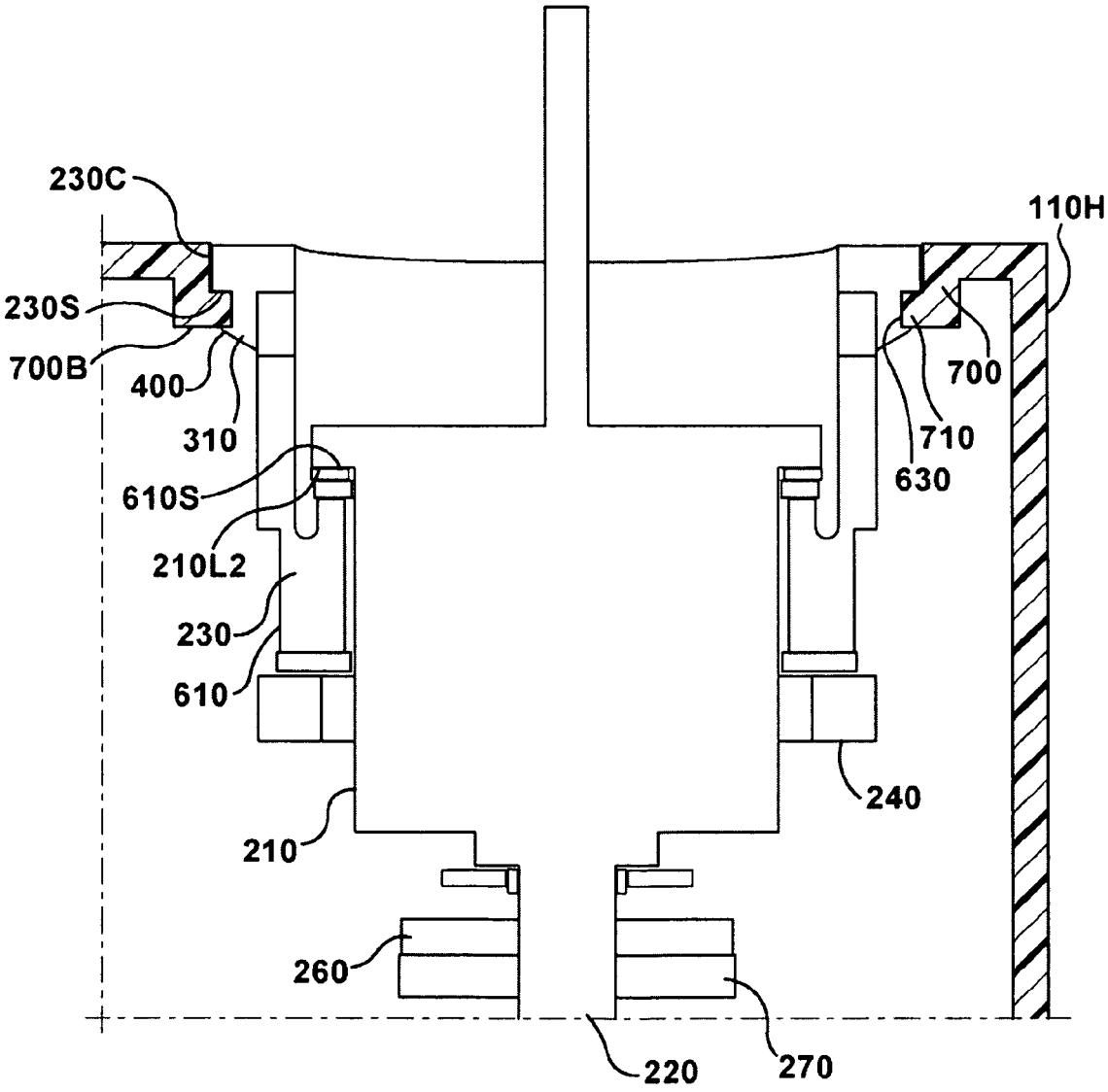
FIG. 7 is a schematic sectional illustration of the lock assembly of FIG. 2 and a portion of the circuit breaker accessory of FIG. 1 in accordance with an exemplary embodiment.
Figure 9:
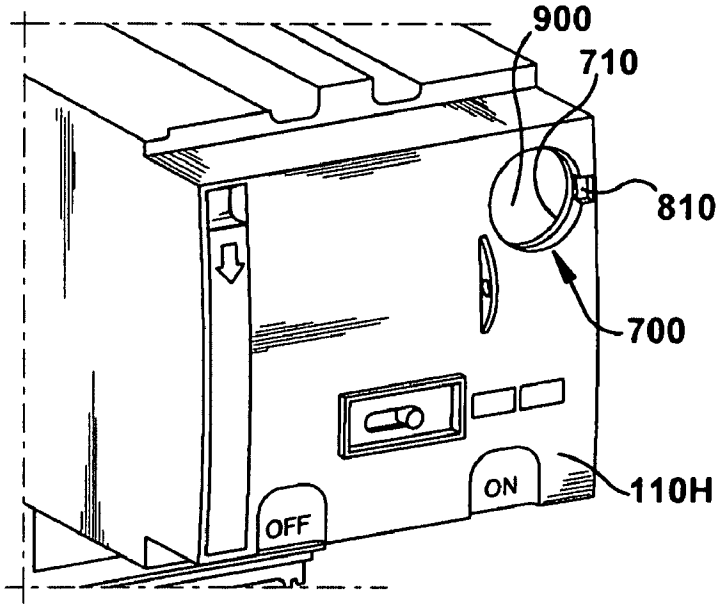
FIGS. 8 through 11 illustrate an exemplary installation of a key assembly in accordance with an exemplary embodiment.
Figure 8:
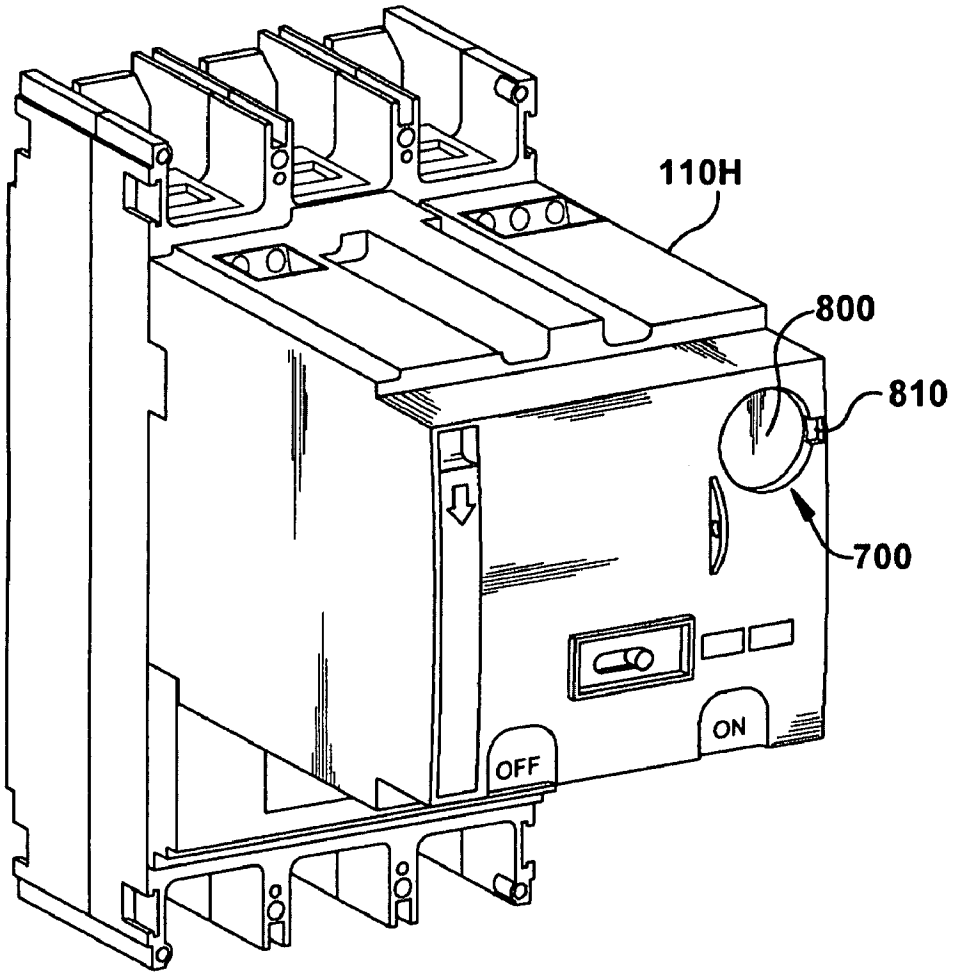
Figure 10:
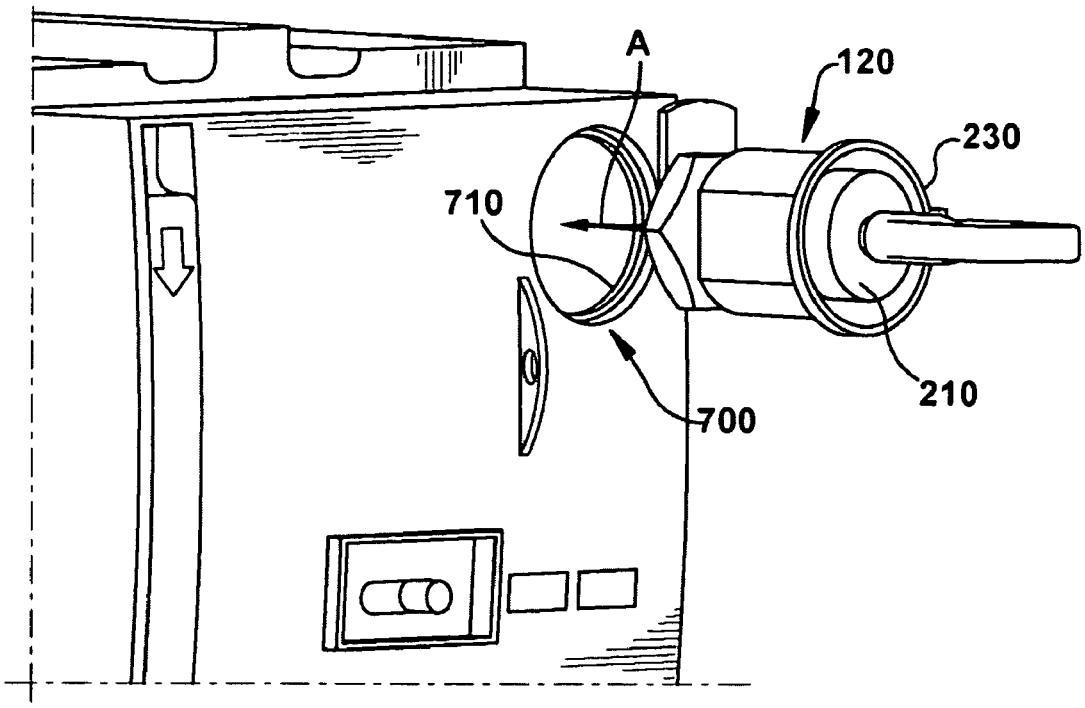
Figure 11:
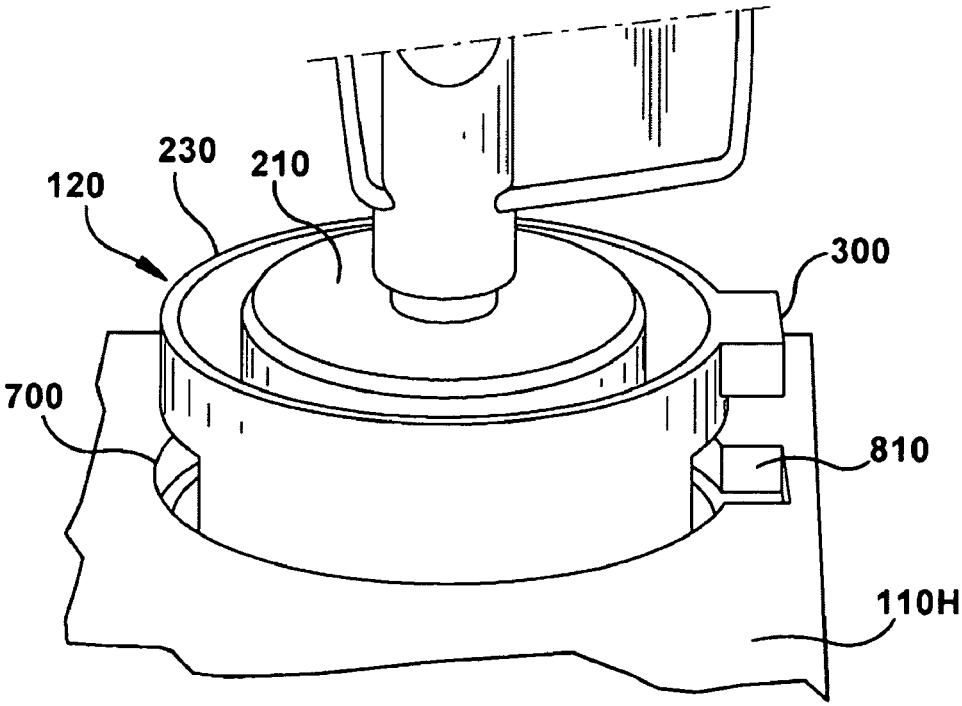

In accordance with an exemplary embodiment, the lock body 210 is inserted into the aperture 230A of the lock housing 230 so that the key 200K (e.g. the keyed end of the lock body) is adjacent to or facing the same direction as the first end 320 of the lock housing 230. When lock body 210 is inserted into the lock housing 230 at least a portion of the lock body 210 and a shaft 220 of the lock extends from a second end 330 of the lock housing 230. At least the portion of the lock body that extends from the second end 330 of the lock housing 230 may be threaded for accepting a nut 240. The nut 240 abuts the second end 330 of the lock housing 230 and works in conjunction with the lip 210L1 and/or shoulder 210L2 for securing the lock body 210 to the lock housing 230. In one example, the lock body may include a slot configured to accept a clip where the clip abuts the second end 330 of the lock housing 230 for securing the lock body 210 in the lock housing 230. In another example, the lock body may include resilient members that engage or snap into suitable features of the lock housing for securing the lock body into the housing. In still other examples, any suitable fastening device may be used to secure the lock body 210 within the lock housing 230. Referring also to FIG. 7, an exemplary illustration of the lock body 210 being secured within the lock housing 230 is shown. In this example, a portion of the lock housing 230 (e.g. the portion of the lock housing 230 forming the flat surface 610) is sandwiched between the shoulders 210L2 of the lock body 210 and the nut 240 for securing the lock body 210 within the lock housing 230.

It is noted that while the exemplary embodiments describe the lock body as being recessed relative to the first end 320 of the lock housing 230, in other examples the lock body 210 may be flush with or extend past the first end of the lock housing 230.

The cam 260 may be configured to engage any suitable portion of the motor operator mechanism for disabling the motor operator 110 and preventing unauthorized use of the motor operator 110. The cam 260 may be fit over shaft 220 and secured to the shaft in any suitable manner. In one example, the cam 260 includes an aperture that conforms to a shape of the shaft 220 such that the cam 260 is non-rotatable relative to the shaft 220. In one example, the shaft 220 includes threads for accepting a nut 270 for securing the cam 260 to the shaft 220 where the nut 270 sandwiches the cam between the nut 270 and a shoulder formed in the shaft 220. Suitable washers or bushings 250 may be added between the cam 260 and the lock body 210 for any suitable purpose including, but not limited to, adjusting a distance between the cam 260 and, for example, the shoulder 230S of the lock housing 230. The washers 250 (in lieu of the shoulder formed in the shaft 220) may work in conjunction with the nut 270 for securing the cam 260 to the shaft 220. The cam 260 may be rotated relative to the lock body 210 (and the lock housing 230) for selectively disabling the motor operator 110 (when the lock assembly 120 is installed on the motor operator housing 110H) by inserting the key 200K into the lock body 210 and turning the key 200K.

Referring now to FIGS. 7-11 an exemplary installation of the lock assembly 120 will be described. In this example, the motor operator housing 110H includes a recess 700 configured to accept the lock assembly 120. The recess 700 includes a lip 710 that extends radially inward so as to form an aperture 900. The aperture is blocked by a knockout 800 that is minimally attached to the lip 710 so that the knockout is easily removed from the aperture 900. The recess also includes a slot 810 configured to accept the tab 300 of the lock housing 230. During installation of the lock assembly 120, the knockout 800 is removed from the aperture 900 in any suitable manner without opening or removing the motor operator housing 110H from the motor operator 110. The lock assembly 120 is inserted through the aperture 900 in the direction of arrow A. As the lock housing 230 is inserted through the aperture 900 the tab 300 of the lock housing is aligned with the slot 810 in the motor operator housing 110H and the resilient members 310 are biased radially inward by the lip 710 of the recess 700. As the resilient member lips 400 pass by the lip 710 of the recess 700 the resilient members 310 snap back into their unbiased position so that the lips 400 are located below and substantially contact a bottom surface 700B of the recess 700 as the shoulder 230S of the collar 230C substantially contacts the lip 710 as best seen in FIG. 7. The resilient member lips 400 and the shoulder 230S capture the lip 710 of the recess 700 in the channel 630 for securing the lock assembly 120 on the motor operator housing 110H while the interaction between the tab 300 of the lock housing 230 and the slot 810 prevent rotation of the lock housing 230 and lock body 210 relative to the motor operator housing 110H. The cam 260 may then be rotated using the key 200K to selectively engage and disable the motor operator mechanism.

While exemplary embodiments have been described in connection with what are presently considered to be the most practical and preferred embodiments, it is to be understood that the embodiments are not limited to those disclosed herein. Rather, the embodiments described are intended to cover all of the various modifications and equivalent arrangements included within the spirit and scope of the appended claims.

What is claimed is:

1. A circuit breaker accessory comprising:

a circuit breaker accessory housing having an aperture;

a lip proximate the aperture;

a lock assembly secured to the circuit breaker accessory housing, the lock assembly configured to selectively disable the circuit breaker accessory, wherein the lock assembly includes, a lock; and a lock housing having:

an aperture configured to retain the lock;

a collar about the aperture, the collar comprising a shoulder configured to contact a first side of the lip of the circuit breaker accessory housing; and at least one resilient member adjacent the aperture, wherein the collar and the at least one resilient member cooperate to capture the lip of the circuit breaker accessory housing;

the at least one resilient member comprising a resilient member lip configured to contact the lip of the circuit breaker accessory housing, the shoulder and resilient member lip being oriented to capture the lip of the circuit breaker accessory housing.

2. The circuit breaker accessory of claim 1, wherein:

the lock comprises a body, the body including a first orientation surface; and the lock housing aperture includes an inner wall having a second orientation surface, wherein the first orientation surface and second orientation surface cooperate to substantially prevent rotation of the body within the lock housing aperture.

3. The circuit breaker accessory of claim 1, wherein the lock housing includes a tab configured to extend radially outward from the collar, the recess being configured to engage the tab to prevent rotation of the lock housing.

4. The circuit breaker accessory of claim 1, wherein the at least one resilient member is integrally formed with the lock housing.

5. The circuit breaker accessory of claim 1, wherein:

the lock housing comprises a first and second end, the collar being disposed at the first end;

the keyed lock comprises a body having a first shoulder;

the aperture comprises an inner wall having a second shoulder configured to interface with the first shoulder; and a fastener abutting the second end is coupled to the body to secure the body within the aperture.

6. The circuit breaker accessory of claim 1, wherein the lock includes a cam configured to selectively disable a mechanism housed within the circuit breaker accessory housing.

7. The circuit breaker accessory of claim 1, wherein the lock assembly is securable within the recess with the circuit breaker accessory housing closed.

* * * * *